US005741218A

United States Patent [19]

Fujii

[11] Patent Number: 5,741,218

[45] Date of Patent: Apr. 21, 1998

[54] VERTICALLY RECIPROCATING PAIRS OF MASSAGE RINGS

[75] Inventor: Yasuo Fujii, Kobe, Japan

[73] Assignee: Family Co., Ltd., Osaka, Japan

[21] Appl. No.: 828,176

[22] Filed: Mar. 18, 1997

[30] Foreign Application Priority Data

Apr. 5, 1996 [JP] Japan ..... 8-119438

[51] Int. Cl.[6] ..... A61H 15/00

[52] U.S. Cl. ..... 601/90; 601/94; 601/96; 601/99; 601/100; 601/103; 601/105; 601/116; 601/122; 601/148

[58] Field of Search ..... 601/51, 52, 61, 601/63, 88, 90–4, 96, 98–103, 105, 110, 111, 115, 116, 126, 127, 148

[56] References Cited

U.S. PATENT DOCUMENTS

| | | | |
|---|---|---|---|
| 3,405,709 | 10/1968 | Mathers | 601/52 |
| 3,640,272 | 2/1972 | Hussey | 601/99 |
| 3,687,133 | 8/1972 | Grubelic | 601/102 |
| 4,003,374 | 1/1977 | Mizrachy | 601/126 X |
| 5,456,657 | 10/1995 | Cheng | 601/98 |

FOREIGN PATENT DOCUMENTS

| | | | |
|---|---|---|---|
| 3429392 | 2/1986 | Germany | 601/113 |

*Primary Examiner*—Danton D. DeMille

*Attorney, Agent, or Firm*—Nikaido, Marmelstein, Murray & Oram LLP

[57] ABSTRACT

The present invention is directed to a massager in which a massage unit comprising kneading rings on the right and left sides is mounted movably up and down inside thereof, and the massage unit is equipped with a plurality of air cells, each of the kneading rings being moved backward and forward or rightward and leftward by an expanding and contracting operation of the air cell or cells.

2 Claims, 7 Drawing Sheets

VERTICALLY RECIPROCATING PAIRS OF MASSAGE RINGS

BACKGROUND OF THE INVENTION

1. Field of the Invention

The present invention relates generally to a massager, and more particularly, to a massager, in which a massage unit comprising kneading rings can be moved up and down in the vertical direction of its main body (in the direction of a person's height), capable of applying various types of massages to the body.

2. Description of the Prior Art

A wide variety of massagers have been conventionally known. Typical examples of the massagers include a chair-type massager. This type of conventional general-purpose massager comprises a massage unit comprising a kneading member composed of one pair or two pairs of rollers and a driving unit for giving various types of swinging movements to the kneading member, as well known. The massage unit can be moved up and down along a backrest surface of a backrest portion.

It is possible to apply such a massage as to roll a portion between a neck portion to a waist portion upon continuously raising and lowering the massage unit or roll the portion while kneading the portion by operating a control unit as well as to stop the massage unit in a desired position to cause kneading rings to perform a selected kneading operation such as kneading, tapping or shiatsu.

However, the conventional general-purpose massager has the following disadvantages because it is so constructed as to transmit the rotation of a motor electrically or mechanically to the kneading member and give various types of kneading movements to the kneading member.

Specifically, noise from the driving unit and an operating unit is produced when the massager is used. As the number of types of operations of the kneading member is increased, the mechanism of the massager becomes complicated, resulting in increased manufacturing cost. Since the flexibility of a function of kneading the body depends on the elasticity of the kneading member itself, it is difficult to obtain such gentle kneading pressure that a user feels as if the body was kneaded with the hands of a person.

Furthermore, in recent years, a chair-type air massager so constructed that an air cell is mounted on an abutting surface of the massager with the body, and the air cell is caused to expand and contract by supplying and exhausting of air to and from the air cell, to apply a massage like shiatsu while operating an air cushion, as disclosed in Japanese Patent Laid-Open No. 124210/1995. In such an air massager, no noise is produced because the kneading member is operated by pneumatic pressure. Therefore, the air massager can be very quietly operated, and a gentle massage is obtained by the air massager.

Since the air cell is fixedly mounted in a predetermined position in such an air massager, however, it is impossible to apply such a massage as to roll a portion between a neck portion to a waist portion of the body while continuously moving a massage unit up and down or roll the portion while kneading the portion and to stop the massage unit in a desired position to perform a selected kneading operation such as kneading, tapping or shiatsu as in the conventional general-purpose massager, whereby the kneading function lacks in variety.

SUMMARY OF THE INVENTION

An object of the present invention is to utilize the advantages of the air massager as well as further promote the characteristics of the conventional general-purpose massager, to provide a massager producing little noise, applying flexible kneading pressure, and capable of applying various types of massages suiting the taste of a user to a desired portion of the user.

The present invention solves the above-mentioned problems by so constructing the massager that a massage unit comprising kneading rings on the right and left sides is mounted movably up and down inside thereof, and the massage unit is equipped with a plurality of air cells, so that each of the kneading rings can be moved backward and forward or rightward and leftward by an expanding and contracting operation of the air cell or cells.

More specifically, a massager according to the present invention comprises a massage unit which is movable back and forth in the vertical direction. The massage unit comprises a base frame supported movably up and down on a main body frame of the massager, a driving mechanism for moving the base frame up and down, a swing plate disposed on the side of the front surface of the base frame and having its center in the vertical direction swingably supported on the base frame through a swinging mechanism including a support shaft extending in the horizontal direction, first and second right and left pairs of swinging members respectively provided in the upper half on the front surface of the swing plate, and respectively having plates in their leading ends, the plates being mounted on the swing plate so as to be rotatable about their base ends in opposite directions forward from a state where they are almost flush with each other, third and fourth right and left pairs of swinging members respectively provided in the lower half on the front surface of the swing plate, and respectively having plates in their leading ends, the plates being mounted on the swing plate so as to be rotatable in opposite directions forward from a state where they are almost flush with each other, kneading rings respectively provided in such a state as to be projected forward in the swinging members, two rear air cells respectively disposed between an upper part of the swing plate and the base frame and between a lower part of the swing plate and the base frame and expanding and contracting by supply and exhaust of air, and four front air cells respectively disposed between the plates of the swinging members and the swing plate and expanding and contracting by supply and exhaust of air. Various types of movements are given to the kneading rings by controlling the supply and exhaust of air to and from the rear air cells and the front air cells.

Examples of the above-mentioned swinging mechanism include one comprising two sets of link mechanisms respectively disposed on both sides of the swing plate. Each of the link mechanisms comprises a first link having its one end pivotably mounted on the center in the vertical direction of the side of the swing plate by a support shaft and having the other end pivotably mounted on the position of an upper part of the side of the base frame, and a second link having its one end pivotably mounted on one end of the first link and the center in the vertical direction of the side of the swing plate by a support shaft and having the other end supported movably only in the vertical direction on the position of a lower part on the side of the base frame.

A preferable example of the above-mentioned air cell applied to the present invention is one obtained by forming a synthetic resin sheet or an unbreathing flexible sheet like leather in a bellows shape and having a function of expanding and contracting in the height direction by supplying and exhausting air thereto and therefrom, and having an effective expansion size in the height direction of approximately 50 to 180 mm. In the expansion range, the swing plate is moved back and forth or is swung in a seesaw shape, and each of the swinging members is rotated back and forth. The movements of the swing plate and each of the swinging members are transmitted to each of the kneading rings, so that the body is massaged.

The two rear air cells disposed between the base frame and the swing plate and the four front air cells disposed between the swing plate and the respective swinging members are so connected to an air control unit by air supply and exhaust tubes that they independently function. The air control unit is equipped with an air pump, a motor, a lot of electromagnetic valves, and an air supply and exhaust circuit for supplying and exhausting air to and from the air cell or cells. The electromagnetic valves are operated by a microcomputer storing a previously set program, to individually operate each of the six air cells or simultaneously operate a plurality of air cells out of the six air cells so that various types of kneading movements are transmitted to the kneading rings.

It is preferable that the kneading ring is formed of an elastic material, so that a gentle massage can be applied to the body by the elasticity of the kneading ring itself and the cushioning function of the air cell.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
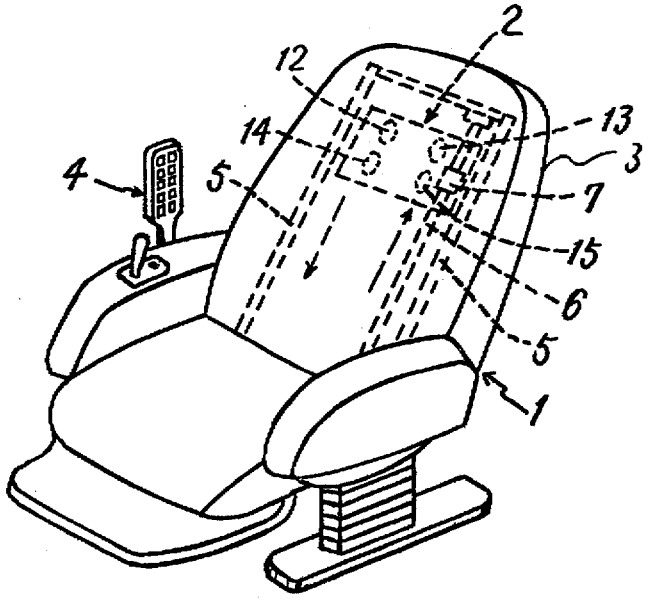
FIG. 1 is a perspective view showing a chair-type massager showing an embodiment of the present invention.

FIG. 1 illustrates the outline of a chair-type massager according to the present invention. Reference numeral 1 denotes a main body of the massager, reference numeral 2 denotes a massage unit provided movably up and down inside of the main body 1 of the massager, reference numeral 3 denotes a backrest portion, and reference numeral 4 denotes an operation controller of the massage unit 2.

Figure 2:
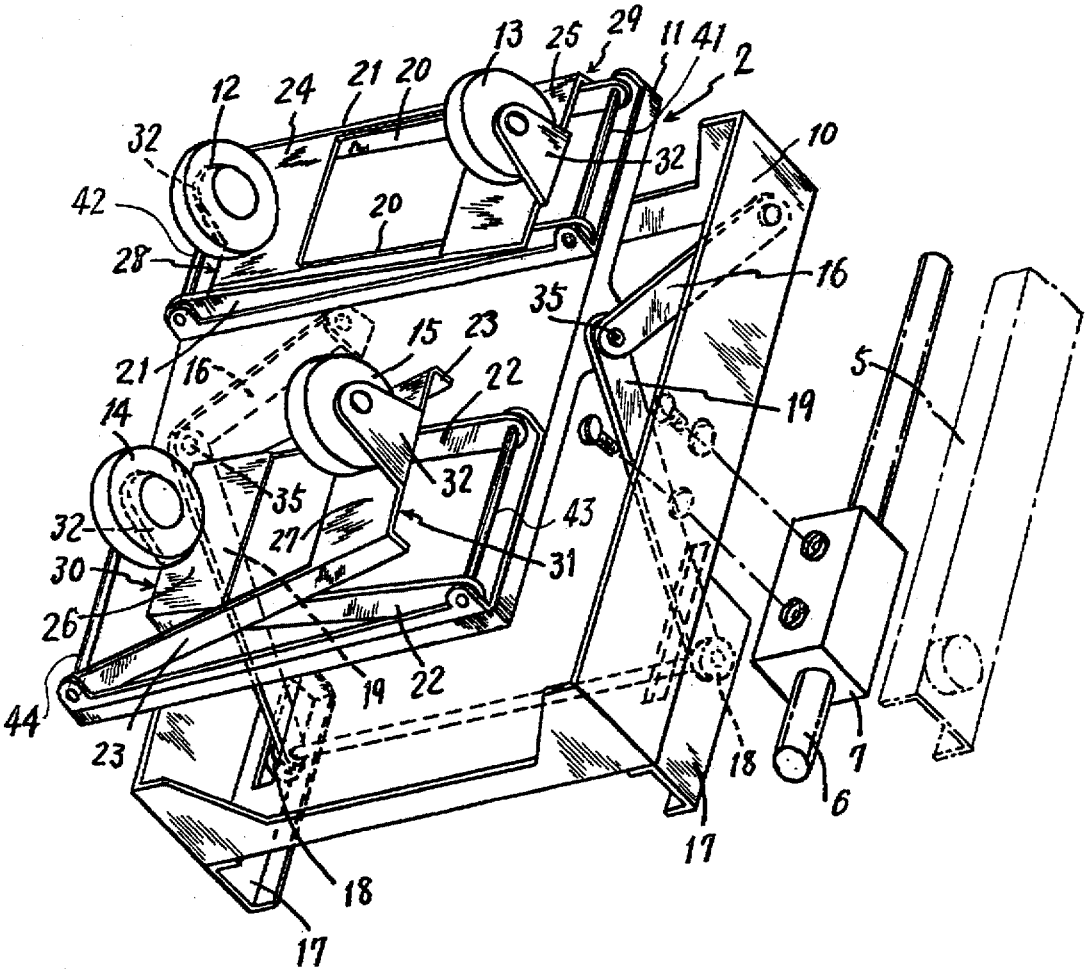
FIG. 2 is a perspective view showing a principal part of a massage unit.

The massage unit 2 is mounted movably up and down along side plates 5 provided on both side of the backrest portion 3 in the main body 1 of the massager, as shown in FIG. 2. The massage unit 2 is raised and lowered in the vertical direction along a backrest surface of the backrest portion 3 by backward and forward rotation of a screw shaft 6 driven by a motor (not shown). Reference numeral 7 denotes a nut member screwed in the screw shaft 6 and mounted on the massage unit 2.

The massage unit 2 comprises a base frame 10 connected to the above-mentioned raising and lowering mechanism in the main body 1 of the massager, a swing plate 11 positioned on the side of the front surface of the base frame 10, and right and left pairs of kneading rings 12, 13, 14, and 15 positioned in upper and lower parts on the side of the front surface of the swing plate 11.

The swing plate 11 is disposed on the side of the front surface of the base frame 10, and has its center in the vertical direction swingably supported on the base frame 10 through a swinging mechanism including a support shaft 35 extending in the horizontal direction. The swinging mechanism comprises two sets of link mechanisms respectively disposed on both sides of the swing plate 11.

Each of the link mechanisms comprises a first link 16 having its one end pivotably mounted on the center in the vertical direction of the side of the swing plate 11 by the support shaft 35 and having the other end pivotably mounted on the position of an upper part of the side of the base frame 10, and a second link 19 having its one end pivotably mounted on one end of the first link 16 and the center in the vertical direction of the side of the swing plate 11 by the support shaft 35 and having the other end pivotably mounted on each of rollers 18 movable along rails 17 provided in positions on both sides of a lower part of the base frame 10. The swing plate 11 is swingable in a seesaw shape about the support shaft 35.

A pair of right and left swinging members 28 and 29 is mounted on the swing plate 11 rotatably about their respective base ends in the upper half on the front surface of the swing plate 11. The one swinging member 28 comprises two levers 20 having their respective right ends pivotably mounted on a right end of the swing plate 11 through a support shaft 41 and a plate 24 so provided as to extend over left ends of both the levers 20. The other swinging member 29 comprises two levers 21 having their respective left ends pivotably mounted on a left end of the swing plate 11 through a support shaft 42 and a plate 25 so provided as to extend over right ends of both the levers 21.

Specifically, the swinging members 28 and 29 are pivotably supported on the swing plate 11 rotatably about the support shafts 41 and 42 in opposite directions, respectively, forward from a state where the plates 24 and 25 are almost flush with each other. Bearings 32 are respectively provided at leading ends of the plates 24 and 25 in the swinging members 28 and 29. The kneading rings 12 and 13 are rotatably supported, respectively, on the bearings 32.

A pair of right and left swinging members 30 and 31 is also mounted on the swing plate 11 rotatably about their respective base ends in the lower half on the front surface of the swing plate 11. The one swinging member 30 comprises two levers 22 having their respective right ends pivotably mounted on a right end of the swing plate 11 through a support shaft 43 and a plate 26 so provided as to extend over left ends of both the levers 22. The other swinging member 31 comprises two levers 23 having their respective left ends pivotably mounted on a left end of the swing plate 11 through a support shaft 44 and a plate 27 so provided as to extend over right ends of both the levers 23.

Specifically, the swinging members 30 and 31 are pivotably supported on the swing plate 11 rotatably about the support shafts 43 and 44 in opposite directions, respectively, forward from a state where the plates 26 and 27 are almost flush with each other. Bearings 32 are respectively provided at leading ends of the plates 26 and 27 in the swinging members 30 and 31. The kneading rings 14 and 15 are rotatably supported, respectively, on the bearings 32.

Figure 3:
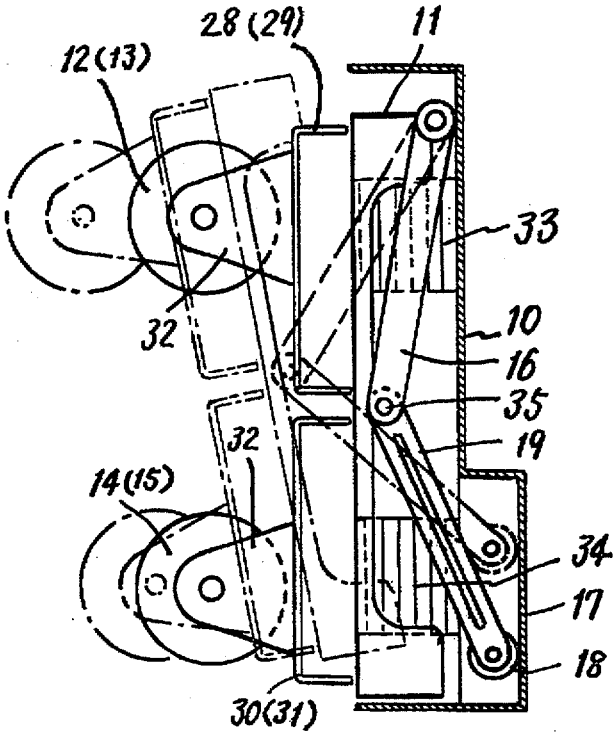
FIG. 3 is a side view showing a state where a swing plate in a massage unit swings.
Figure 5:
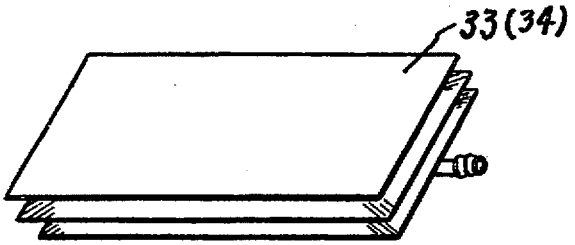
FIG. 5 is a perspective view showing a rear air cell.

Rear air cells 33 and 34 expanding and contracting by supply and exhaust of air, as shown in FIG. 3, are respectively provided between an upper part of the swing plate 11 and the base frame 10 and between a lower part of the swing plate 11 and the base frame 10. The swing plate 11 can be moved back and forth by supplying and exhausting air to and from the rear air cells 33 and 34, or the swing plate 11 can be inclined about the support shaft 35 as indicated by a broken line in FIG. 3 by supplying air to one of the air cells 33 and 34 to expand the air cell. FIG. 5 illustrates one example of the rear air cell.

Figure 6:
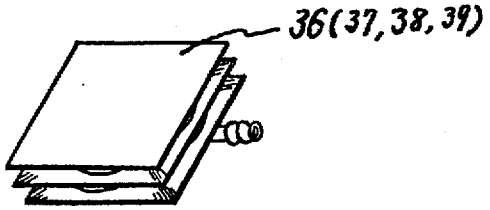
FIG. 6 is a perspective view showing a front air cell.
Figure 10:
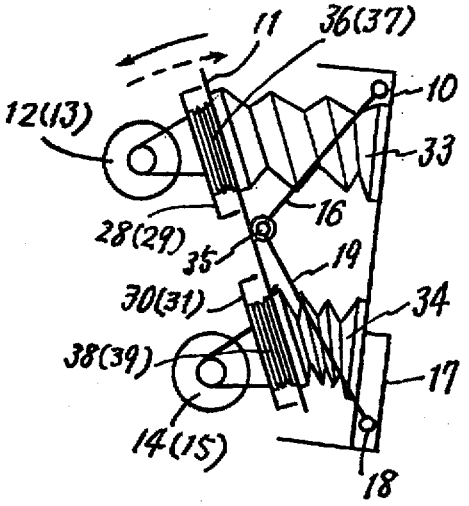
FIG. 10 is an explanatory view showing massaging operations.

Front air cells 36, 37, 38, and 39 expanding and contracting by supply and exhaust of air, as shown in FIG. 10, are respectively provided between the plates 24, 25, 26, and 27 of the swinging members 28, 29, 30, and 31 and the swing plate 11. Air is supplied and exhausted to and from the front air cells 36, 37, 38 and 39, so that circular arc movements in the lateral direction as indicated by arrows in FIG. 4 can be given to the kneading rings 12, 13, 14, and 15. FIG. 6 illustrates one example of the front air cell.

The two rear air cells 33 and 34 disposed between the base frame 10 and the swing plate 11 and the four front air cells 36, 37, 38, and 39 disposed between the sing plate 11 and the respective swinging members 28, 29, 30, and 31 are so connected to an air control unit (not shown) by air supply and exhaust tubes (not shown) that they independently function.

The air control unit is equipped with an air pump, a motor, a lot of electromagnetic valves, and an air supply and exhaust circuit for supplying and exhausting air to and from the air cell or cells. When a previously set program is stored in a microcomputer, and a desired kneading operation displayed on the operation control unit 4 is selected, the electromagnetic valves are operated by a command from the microcomputer, to individually operate each of the six air cells or simultaneously operate a plurality of air cells out of the six air cells to move the swing plate 11 and the swinging members 28, 29, 30, and 31, so that the four kneading rings 12, 13, 14, and 15 are caused to perform the desired kneading operation.

Description is now made of operations of the massager.

(1) Description is made of operations in a case where a user operates the operation control unit 4 to raise or lower the massage unit 2 and stop the massage unit 2 in a desired position of the user's body, and then selects a mode "shiatsu" out of modes in the operation control unit 4 to turn a driving switch on.

Figure 7:
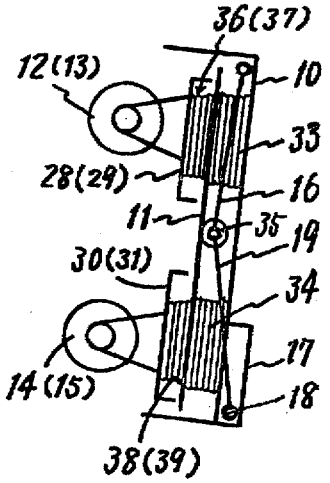
FIG. 7 is an explanatory view showing massaging operations.
Figure 8:
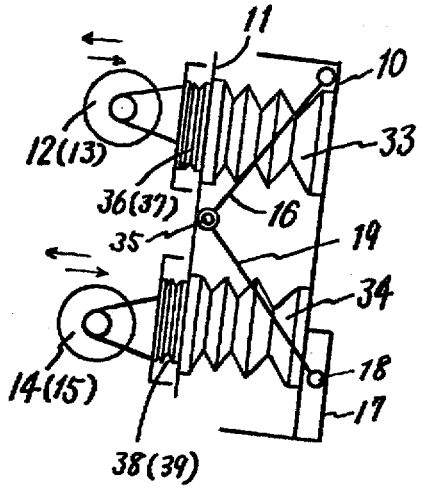
FIG. 8 is an explanatory view showing massaging operations.
Figure 9:
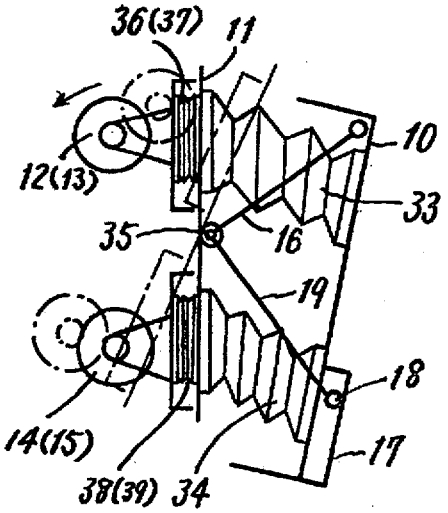
FIG. 9 is an explanatory view showing massaging operations.

In this case, air is slowly supplied and exhausted to and from the rear air cells 33 and 34, so that the rear air cells 33 and 34 expand and contract. Consequently, the swing plate 11 is slowly moved back and forth, so that the four kneading rings 12, 13, 14, and 15 are simultaneously moved nearer to and away from the body (see FIGS. 7 and 8). Air is sometimes alternately supplied and evaluated to and from the rear air cells 33 and 34. Consequently, the swing plate 11 is swung in a seesaw shape about the support shaft 35, as shown in FIG. 9, so that the body is alternately pressed by the kneading rings 12 and 13 on the upper side and the kneading rings 14 and 15 on the lower side. Therefore, a comfortable massage like shiatsu is applied upon effective exertion of cushioning properties of each of the air cells.

(2) Description is made of operations in a case where the user operates the operation control unit 4 to raise the massage unit 2 and stop the two kneading rings 12 and 13 on the upper side in the massage unit 2 in the position of the shoulder, for example, of the user's body, and then turns a mode "kneading shiatsu" out of the modes in the operation controller 4 on.

In this case, the air control unit is commanded to operate by the microcomputer. Air is simultaneously supplied and exhausted to and from the two front air cells 36 and 37 provided in the upper half of the swing plate 11, so that the two front air cells 36 and 37 expand and contract. Consequently, the right and left swinging members 28 and 29 are rotated back and forth in opposite directions, so that the spacing between the kneading rings is decreased at the time of forward movements of the kneading rings 12 and 13, while being increased at the time of backward movements of the kneading rings 12 and 13, as indicated by arrows in FIG. 4. The foregoing operations are repeated. Therefore, a kneading shiatsu massage is applied to the shoulder.

Such operations that air is supplied and exhausted to and from the rear air cell 33 positioned on the rear surface in the upper half of the swing plate 11, so that the rear air cell 33 expands at the time of forward movements of the kneading rings 12 and 13, while contracting at the time of backward movements of the kneading rings 12 and 13 are sometimes added. Consequently, the kneading rings 12 and 13 are caused to have a so-called push and pull kneading function depending on stiffness. Therefore, a shoulder kneading massage is effectively applied in cooperation with the cushioning properties of the air cell.

(3) When the user turns a mode "tapping" out of the modes in the operation controller 4 on, the air control unit is commanded to operate by the microcomputer. Air is supplied and evaluated at high speed to and from the rear air cell 33 on the upper side between the base frame 10 and the swing plate 11, so that the rear air cell 33 expands and contracts as shown in FIG. 10. Consequently, the swing plate 11 is swung back and forth, so that the kneading rings 12 and 13 on the upper side are caused to have a tapping function as indicated by arrows. Therefore, a tapping massage is applied.

In a case where it is desired to reduce the degree of tapping, when the user turns a mode "weak" out of the modes in the operation controller 41 on, air is supplied and exhausted to and from the front air cells 36 and 37 positioned on the side of the rear surfaces of the kneading rings 12 and 13 in order that the front air cells 36 and 37 expand at the time of contraction of the rear air cell 33, while contracting at the time of expansion of the rear air cell 33. Therefore, the degree of tapping can be also reduced by decreasing a tapping stroke.

Figure 11:
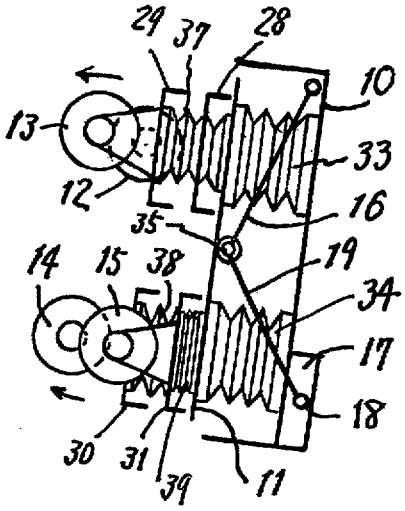
FIG. 11 is an explanatory view showing massaging operations.

(4) Furthermore, in a case where a gentle tapping massage using the four kneading rings 12, 13, 14, and 15 is required, when the user turns a mode "tapping and kneading" on, the front air cells 36 and 37 on the side of the rear surfaces of the two kneading rings 12 and 13 on the upper side and the front air cells 38 and 39 on the side of the rear surfaces of the two kneading rings 14 and 15 on the lower side alternately expand and contract at high speed, as shown in FIG. 11, so that a massage was applied as if the body was tapped and kneaded with four hands.

(5) When the user turns a mode "roller" out of the modes in the operation controller 4 on, the raising and lowering mechanism in the main body 1 of the massager is operated so that the massage unit 2 is moved up and down. Consequently, the four kneading rings 12, 13, 14, and 15 are moved back and forth along both sides of the backbone of the body, to perform a rolling massaging function for correcting the backbone. In this case, the strength of the kneading rings exerted on the back can be adjusted by supplying and exhausting air to and from the front air cells 36, 37, 38, and 39.

Figure 12:
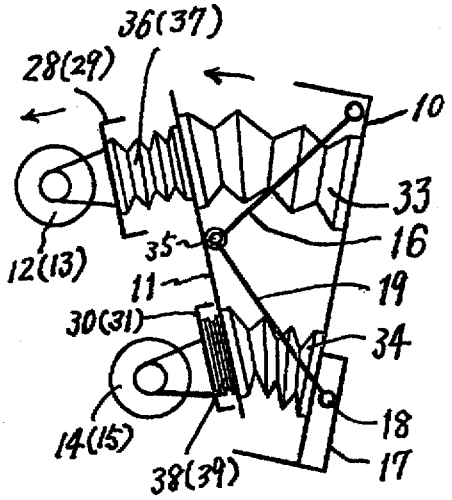
FIG. 12 is an explanatory view showing massaging operations.

Furthermore, when the mode "roller" is selected, the air supply and exhaust tubes of the rear air cells 33 and 34 communicate with each other on the basis of its program, whereby the positions of the kneading rings 12 and 13 on the upper side and the kneading rings 14 and 15 on the lower side vary due to the curve of the body between vertical movement strokes of the kneading rings 12, 13, 14, and 15. In this case, when the internal pressure of either one of the rear air cells 33 and 34 on the upper and lower sides is increased, air in the air cell flows into the other air cell so that the internal pressures of both the air cells 33 and 34 are equalized. Consequently, the swing plate 11 is swung in a seesaw shape so that the upper and lower kneading rings are swung, whereby the abutting pressure of the kneading rings with the body is adjusted. Further, the swing plate 11 is greatly inclined forward when the massage unit 2 is raised to reach its uppermost position, as shown in FIG. 12, and corrects the inclination as the massage unit 2 is lowered. A rolling massage can be thus applied.

Figure 4:
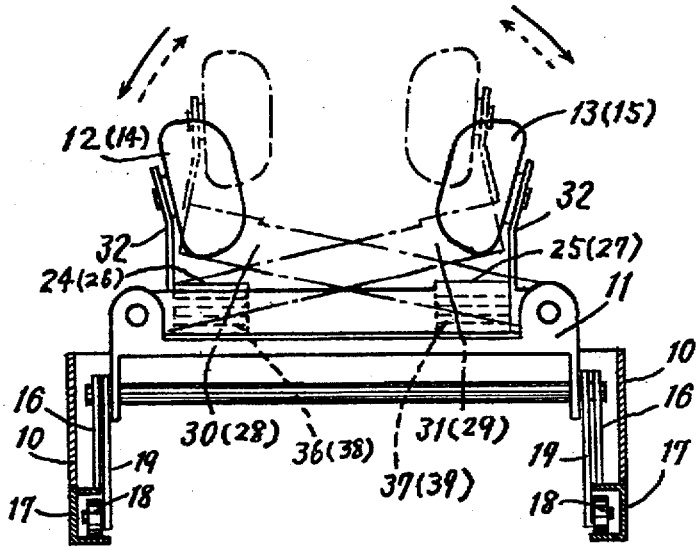
FIG. 4 is a front view showing the movement of kneading rings by angular rotation of a frame member in a massage unit.

In a case where the massage unit 2 is raised to reach its uppermost position, or is lowered to reach a waist portion of the body, when the user stops the massage unit 2, and turns a mode "kneading" on, the movement shown in FIG. 4 is given to the kneading rings 12 and 13 or 14 and 15. Therefore, a kneading massage can be intensively applied to the vicinity of the scruff of the neck or the waist of the body.

According to the above-mentioned massager, a variety of massages such as shiatsu, tapping, rolling and kneading shiatsu can be applied by controlling the supply and exhaust of air to and from the rear air cells 33 and 34 and the front air cells 36, 37, 38 and 39 on the basis of a predetermined program.

Furthermore, massaging operations using the four kneading rings 12, 13, 14, and 15 are performed by supplying and exhausting air to and from the air cells 33, 34, 36, 37, 38 and 39, whereby noise is hardly produced, and the strength and weakness can be adjusted by controlling the degree of expansion and contraction. Further, the air cells are abundant in cushioning properties, whereby the kneading rings 12, 13, 14, and 15 flexibly operate on the body, to obtain a comfortable massage.

Although in the above-mentioned embodiments, the present invention was described with respect to the chair-type massager, it goes without saying that the construction of the present invention is also applicable to a bed-type massager.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A massager comprising a massage unit which is movable back and forth in the vertical direction, wherein the massage unit comprises a base frame supported movably up and down on a main body frame of the massager, a driving mechanism for moving the base frame up and down, a swing plate disposed on the side of the front surface of the base frame and having its center in the vertical direction swingably supported on the base frame through a swinging mechanism including a support shaft extending in the horizontal direction, first and second right and left pairs of swinging members respectively provided in the upper half on the front surface of the swing plate, and respectively having plates in their leading ends, the plates being mounted on the swing plate so as to be rotatable about their base ends in opposite directions forward from a state where they are almost flush with each other, third and fourth right and left pairs of swinging members respectively provided in the lower half on the front surface of the swing plate, and respectively having plates in their leading ends, the plates being mounted on the swing plate so as to be rotatable in opposite directions forward from a state where they are almost flush with each other, kneading rings respectively provided in such a state as to be projected forward in the swinging members, two rear air cells respectively disposed between an upper part of the swing plate and the base frame and between a lower part of the swing plate and the base frame and expanding and contracting by supply and exhaust of air, and four front air cells respectively disposed between the plates of the swinging members and the swing plate and expanding and contracting by supply and exhaust of air, various types of movements being given to the kneading rings by controlling the supply and exhaust of air to and from the rear air cells and the front air cells.

2. The massager according to claim 1, wherein said swinging mechanism comprises two sets of link mechanisms respectively disposed on both sides of the swing plate, each of the link mechanisms comprising a first link having its one end pivotably mounted on the center in the vertical direction of the side of the swing plate by a support shaft and having the other end pivotably mounted on the position of an upper part of the side of the base frame, and a second link having its one end pivotably mounted on one end of the first link and the center in the vertical direction of the side of the swing plate by a support shaft and having the other end supported movably only in the vertical direction on the position of a lower part of the side of the base frame.

* * * * *